United States Patent [19]

Hoffmann

[11] Patent Number: 4,575,589

[45] Date of Patent: Mar. 11, 1986

[54] SWITCHING CONTACT ARRANGEMENT, IN PARTICULAR FOR KEYBOARDS AND A KEYBOARD

[75] Inventor: Horst Hoffmann, Glonn, Fed. Rep. of Germany

[73] Assignee: Firma Wilhelm Ruf KG, Munich, Fed. Rep. of Germany

[21] Appl. No.: 627,755

[22] Filed: Jul. 5, 1984

[30] Foreign Application Priority Data

Jul. 27, 1983 [DE] Fed. Rep. of Germany ..... 3327130

[51] Int. Cl.[4] ..... H01H 3/12

[52] U.S. Cl. ..... 200/5 A; 200/159 B

[58] Field of Search ..... 200/5 A, 159 B

[56] References Cited

U.S. PATENT DOCUMENTS

| | | | |
|---|---|---|---|
| 3,973,091 | 8/1976 | Kaminsky | 200/5 A |
| 4,128,744 | 12/1978 | Seeger | 200/5 A |
| 4,287,394 | 9/1981 | Hargita et al. | 200/5 A |

*Primary Examiner*—Reinhard J. Eisenzopf

*Assistant Examiner*—Morris Ginsburg

*Attorney, Agent, or Firm*—Cushman, Darby & Cushman

[57] ABSTRACT

The switching contact arrangement contains a support or base (1), above it a layer of at least two tracks approaching each other at an angle, one of which comprises a switching contact surface (11). The other one (13, 13') is divided in the region of the switching contact surfaces (11) and their track sections, so that a space is formed there. An insulating layer is provided in the region of the track intersection to be formed. A layer (30) of electrically conductive material is then applied thereto, which has a recess in the region of the switching contact surfaces (11). This layer also serves as a bridge for the track intersection and as a switching contact surface for a switching surface (41 or 43) arranged thereabove and made of a flexible, electrically conductive material. In addition, the electrically conductive layer (30) serves as a spacer for the switching surface (41). A particularly compact switching contact arrangement is provided by integrating the switching contact surface and the bridge.

19 Claims, 5 Drawing Figures

SWITCHING CONTACT ARRANGEMENT, IN PARTICULAR FOR KEYBOARDS AND A KEYBOARD

BACKGROUND OF THE INVENTION

This invention concerns a switching contact arrangement, in particular for keyboards, comprising a support or base made of an electrically insulating material, further comprising at least a first and a second track disposed in one plane on the support, said tracks being each connected to a first and second switching contact surface respectively and the switching contact surfaces which form one pair of switching contacts being spaced apart, still comprising a movable, flexible switching contact surface made of an electrically conductive material, said contact surface being in contact with all switching contact surfaces associated therewith when in its end position, whereas it is spaced apart from at least one of the switching contact surfaces when in its other end position, and still further comprising track intersections in which the tracks intersecting each other are separated from each other by means of an insulating layer.

DESCRIPTION OF THE PRIOR ART

Such a switching contact arrangement is known from German utility model No. 76 24 175 which corresponds to U.S. Pat. No. 4,287,394.

A similar switching contact arrangement, however without track intersections, is also described in the prior German patent application No. P 33 16 616.1 which corresponds to my copending U.S. application Ser. No. 602,431, filed Apr. 20, 1984.

In switching contact arrangements, in which the tracks to be electrically connected and switched are disposed in one and the same plane in a carrier material, the switching contact surfaces are normally embodied as enlargements of the tracks (also known as "bread rolls" or meshing combs), and an insulating layer with a recess in the region of the switching contact surfaces serves as a spacer with respect to the switching surface which is generally arranged on a switching film and is electrically conductive and flexible. To operate the switch, this flexible switching surface is pressed through the recess and thereby comes in contact with the switching contact surfaces of the tracks, whereby the electrical connection is established (see German utility model No. 76 28 275, which corresponds to U.S. Pat. No. 4,046,975 and the aforementioned German utility model No. 76 24 175).

If a multiple of switching contact arrangements are to be combined on a support or base so as to form a keyboard, the proximity of the tracks with respect to one another presents some problems. It has therefore been suggested that the tracks to be connected to one another be arranged in various planes or levels (German published application No. 2,805,722, which corresponds to U.S. Pat. No. 4,128,744, and German published application No. 2,649,667).

German utility model No. 76 24 175 has also proposed accomodating the intersecting tracks and switching contact surfaces on one and the same baseplate, a change of levels thereby being made only in the region of the intersections of the tracks on the basis of the necessary intermediate insulating layers. The track intersections and the switching contact surfaces are, however, spaced so far apart that, on the whole, considerable space is required on the baseplate. If the track intersections are formed by printed bridges, which is often carried out by means of conductive lacquer containing carbon and/or silver, one meets the additional problem of the high resistivity of the bridges. If low-impedance bridges are to be produced, they have to be extensive in area, which means that even more space is required.

OBJECT OF THE INVENTION

It is therefore the object of this invention to improve the switching contact arrangement of the type described hereinbefore so that it permits track intersections with little available space and is therefore suitable particularly for keyboards. In addition, the track intersections should have as low an impedance as possible; they should also be simple to manufacture.

SUMMARY OF THE INVENTION

In accordance with the invention, this object is solved in that an electrically conductive layer (bridge) (30) forming the track crossing at the same time forms the second switching contact surface.

The gist of the invention is that the track intersections, or the bridge forming them, are integrated in the switching contact. A part of the bridge at the same time forms a (second) switching contact surface. This part of the bridge preferably assumes the spacer function at the same time together with the intermediate insulating layer.

The space saved by integrating the bridge and the switching contact allows the bridge to be larger, whereby it can be designed so as to have a very low impedance. A preferred further embodiment of the invention provides that one track continues in the region of the switching contact arrangement into a pair of enlargements which are spaced a distance apart from the other track and its switching contact surface. These enlargements are connected to each other by means of a layer made of an electrically conductive material (which forms the bridge), and at least one section of this layer forms the switching contact surface for the track connected electrically to it.

According to one embodiment example of the invention the edges of the enlargements pointing towards one another enclose between them a section of the other track and its switching contact surface.

In order to improve the insulation of the switching contact surfaces, a further embodiment of the invention provides that the intermediate insulating layer extends additionally about the first switching contact surface and partly covers it. This additional part of the intermediate insulating layer is preferably in a single piece along with the insulating layer covering the first track in the region of the track intersection.

According to another embodiment of the invention the first switching contact surface is substantially circular and the conductive layer also has a substantially recess and the centres of the two circles are aligned in one axis. According to a further development of this embodiment the internal diameter of the recess of the conductive layer is larger than the external diameter of the first switching contact surface. In this embodiment the switching contact surfaces are always spaced apart even without the use of an intermediate insulating layer.

In the embodiment of the invention in which the intermediate insulating layer extends in addition round about the first switching contact surface and partly covers it, a further modified development comprises having the internal diameter of the recess of the conductive layer smaller or equal to the external diameter of the first switching contact surface and having adjacent and/or opposite surfaces of the first switching contact surface and the electrically conductive layer separated from one another by means of the intermediate insulating layer in the form of annulus.

A further development of this embodiment is that the intermediate insulating layer, which extends about the first switching contact surface, is annular and its centric opening is circular, and the centre of the latter is aligned with the centre of the first circular switching contact surface and the centre of the circular recess of the conductive layer.

The intermediate insulating layer is preferably printed by means of an insulating lacquer or comprises a photoresist layer. This concerns both the insulating layer, which cover the tracks in the region of the bridges, and also the annular insulating layer. All insulating layers are printed in a single operation.

The layer forming the bridge and the second switching contact surface is preferably printed by means of a conductive lacquer containing carbon or copper and carbon or carbon and silver. A preferred application of the switching contact arrangement described above is for keyboards, in particular matrix keyboards. The advantage of being very compact can be exploited here to the full.

Advantageous embodiments and further developments of the invention are described hereinafter.

BRIEF DESCRIPTION OF THE DRAWINGS

The invention will now be described in the following in more detail by means of embodiment examples and with reference to the drawing, in which.

The same reference numbers in the various Figures refer to the same parts.

DETAILED DESCRIPTION OF PREFERRED EMBODIMENTS OF THE INVENTION

Figure 1:
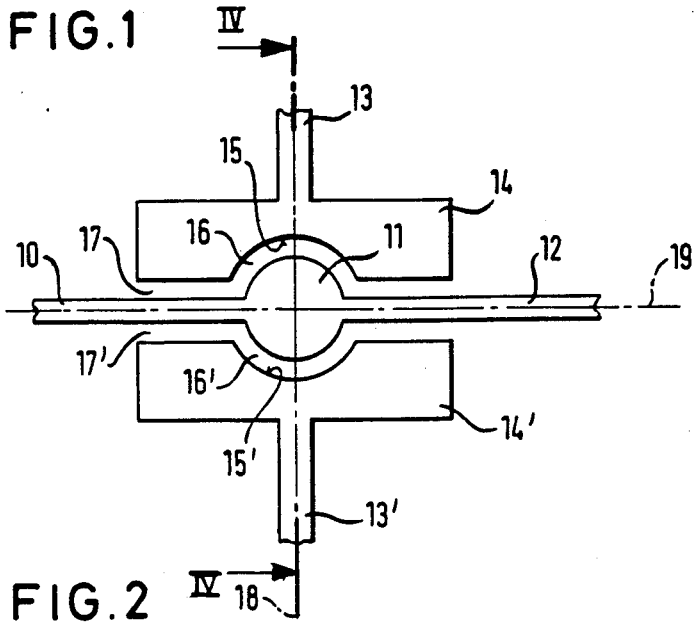
FIG. 1 is a schematic top view of the tracks (first layer) of a switching contact arrangement in accordance with the invention.

The switching contact arrangement contains a support 1 (FIG. 4) made of an electrically non-conductive material, e.g. paper-base laminate, plastic etc. A first layer comprising an electrically conductive material is first applied to this support or base. Its configuration is shown in FIG. 1. A first track is shown here with its sections 10 and 12. These sections have an enlargement, which serves as first switching contact surface 11, disposed between them. The enlargement is in this case substantially circular. The switching contact surface 11 is formed in a single unit together with the track sections 10 and 12 and is therefore in electrical contact with the latter. The track sections 10 and 12 are disposed on a axis 19 which also runs through the centre of the switching contact surface 11.

A second track, which is also applied in the same plane as tracks 10 and 12 on the base plate 1, has two track sections 13 and 13' which extend along an axis 18 which is perpendicular to axis 19, so that the tracks 13, 13' and 10, 12 form track intersections in the region of the intersection of the axes 18 and 19. The track sections 13 and 13' have enlargements 14 and 14' which are symetrical images of each other along the axis 19. The enlargements are substantially rectangular in this case and have a central recess 15. The edges of the enlargements 14 and 14' pointing towards the axis 19 extend parallel to the opposite edges of the track sections 10 and 12 and the first switching contact surface 11. The space between the enlargements and the opposite sections of the tracks 10 and 12 is referenced by 17 and 17', whereas the distance between the recess 15 and the outer contour of the first switching contact surface 11 is referenced by 16 and 16'. These spaces 16, 16'; 17, 17' have a substantially constant size and produce the separation of the track 13, 13'.

The enlargements 14, 14' are, in comparison to the width of the track sections 13 and 13', relatively spacious. In a practical embodiment in which the track sections 13 and 13' have a width of aproximately 1 mm., the width of the enlargements perpendicular to the axis 18 is approximately 13 mm., whereas the length of the individual enlargements 14 and 14' perpendicular to the axis 19 is approximately 3 to 4 mm. In this embodiment example the diameter of the switching contact surface 11 is approximately 5 mm. Other dimensions may of course be used.

Figure 2:
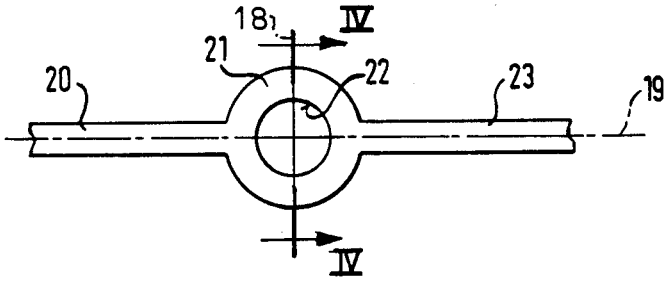
FIG. 2 is a schematic top view of the intermediate insulating layer (second layer) of the switching contact arrangement in accordance with the invention.
Figure 3:
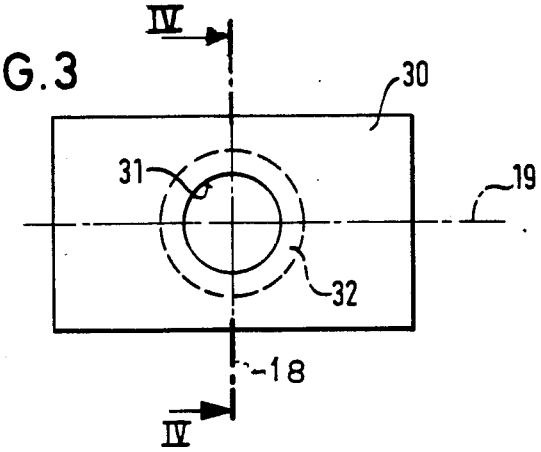
FIG. 3 is a schematic top view of the electrically conductive layer (third layer) of the switching contact arrangement in accordance with the invention.

For forming a track bridge, with which the tracks 13 and 13' or their enlargements 14 and 14' are electrically connected via the first track with its sections 10 and 12, an intermediate insulation have the contours illustrated in FIG. 2 is applied as a second layer. It is preferably printed using an insulating lacquer or embodied as a photoresist layer. This second layer consists of sections 20 and 23 which are applied to the track sections 10 and 12 at least in the region of the "bridge". The insulating layer section 20 and 23 extend along the axis 19, which is also shown in FIG. 2. The axes 19 of FIGS. 1 and 2 and also the axis 19 in FIG. 3 are superimposed when the switching contact arrangement is completed.

The insulating sections 20 and 23 are wider than the track sections 10 and 12 to be covered by them and therefore project into the spaces 17 and 17'. The length of the insulating layer sections 20 and 23 (in the direction of axis 19) correspond to at least the width of the enlargements 14 and 14' (measured perpendicular to axis 18).

In the embodiment example shown here, the space 16 and 16' between the first switching contact surface 11 and the recess 15 and 15' is also covered by an insulating layer. An insulating ring is provided for this purpose. It is arranged between the insulating layer sections 20 and 23 and connected to the latter to form a single piece. Its centre is the point of intersection of the axes 18 and 19. The contour of the central recess 22 is adapted to fit the first switching contact surface 11 and is therefore circular. The diameter of the recess 22 is smaller than the external diameter of the switching contact surface 11 in the embodiment example shown. The insulating ring 21 will therefore partly cover the switching contact surface 11 (see FIG. 4). The external diameter of the insulating ring 21 corresponds to the diameter of the recess 15 and 15' in this embodiment example, so that the insulating ring will exactly fill the space 16 and 16'. In the region of the space 16 and 16', the layer thickness of the insulating ring is greater than the layer thickness of the switching contact surface 11 or the track sections 13 and 13' because of the above-mentioned overlapping of the first switching contact surface 11.

After the insulating layer according to FIG. 2 has been applied, a layer 30 made of an electrically conductive material is applied as third layer. This third layer is preferably a conductive lacquer containing carbon or carbon and silver. The configuration of this layer 30 is shown in FIG. 3. This layer is substantially rectangular and adapted to fit the contours of the enlargements 14 and 14' so that it will completely cover the latter. The layer 30 has a central recess 31 which is adapted to the shape of the switching contact surface 11 and is therefore circular in this case. The centre of the recess 31 is the point of intersection of the axes 18 and 19. The diameter of the recess 31 is selected such that the switching contact surface 11 is not connected electrically to the layer 30.

In a modified embodiment (FIG. 4), in which the insulating ring somewhat overlaps the switching contact surface 11, the internal diameter of the recess 31 may correspond exactly to the external diameter of the switching contact surface 11; or it may be smaller. However, it may not be smaller than the internal diameter of the recess 22 of the insulating ring.

According to a further modified embodiment example of the invention (not shown), in which the insulating ring 21 is either completely omitted or at least does not overlap the switching contact surface 11, the internal diameter of the recess 31 has to be greater than the external diameter of the switching contact surface 11. In the modified embodiment, in which the insulating ring 21 is completely omitted, the internal diameter of the recess 31 is preferably roughly equal to the diameter of the recesses 15 and 15', so that the space 16 and 16' produces the electric separation or insulation between the switching contact surface 11 and the electrically conductive layer 30.

On the one hand, the electrically conductive layer 30 is a "track bridge" which electrically connects the enlargements 14 and 14' and hence the track section 13 and 13' with each other via the track 10, 12. At the same time, the layer 30 is also a (second) switching contact surface 32, which is indicated in FIG. 3 with broken lines. This dual function, in which the track bridge and the switching contact surface are integrated, is of particular importance. A third function of layer 30, which is also very important, is that it also forms a spacer. This will be explained in the following with reference to FIG. 4.

For the switching operation, in which the switching contact surfaces 11 and 32 are connected to each other, a switching film 40 comprising a flexible, electrically insulating material is usually provided. This film has a "switching surface" 41, which comprises and electrically conductive, flexible material, applied to it opposite the switching contact surfaces to be connected to each other. The film 40 rests on the layer 30, and the switching surface 41, which is also circular when viewed from above (top view not shown), also lies within the outer edge on the layer 30 in the region of the (second) switching contact 32 (see FIG. 3). Thus the second switching contact surface 32 also serves as a spacer for the switching surface 41 since the latter is spaced apart from the first switching contact surface in the non-operational state. When mechanical pressure is applied to the upper side of the film 40, the switching surface 41 is pressed through the recesses 31 and 22 until its central portion comes into contact with the switching contact surface 11. In this way, the switching contact surfaces 11 and 32 are connected via the switching surfaces 41, whereby the desired connection between the tracks 10, 12 and 13, 13' is ultimately established.

The centre of the circular switching surface 41 shown here lies on axis 45 which also extends through the points of intersection of axes 18 and 19 of FIGS. 1 to 3.

Figure 4:
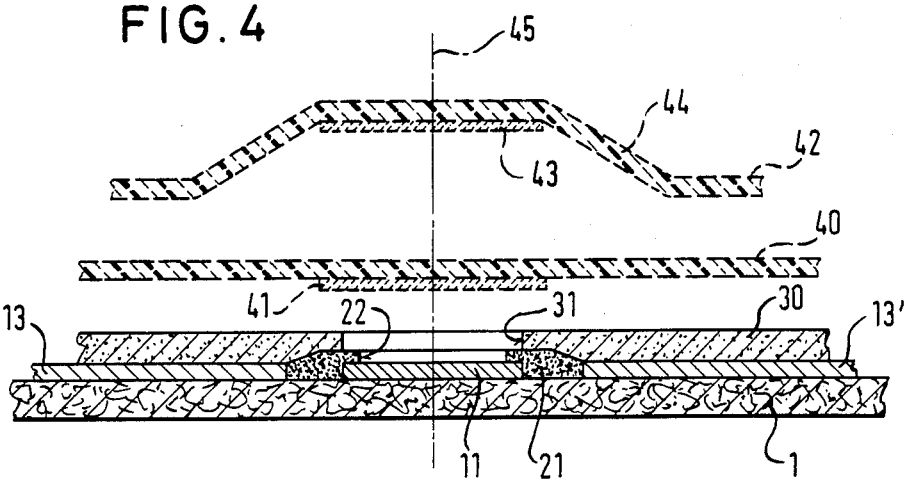
FIG. 4 is a schematic sectional view of a switching contact arrangement along the lines IV—IV of FIGS. 1 to 3 indicating two modified embodiments of a switching film with switching surface or a switching mat with a conductive contact surface.

A so-called "switching mat", which is made of silicon rubber or thermoplastic resin or elastomer, can also be used instead of a flat switching film 40. Such a switching mat 42 is shown in FIG. 4. In the region of the switching surface 43, the switching mat is curved away from the switching contact surfaces associated therewith; this is indicated by the bevel 44 in the Figure. The horizontal parts of this switching mat rest on the layer 30, whereas the switching surface 43 is spaced apart from the two switching contact surfaces 21 and 11 when in the non-operational state. Such switching mats are described for example in German utility model No. 76 24 175.3 mentioned at the beginning. In this instance the layer 30 does not serve as a spacer.

Figure 5:
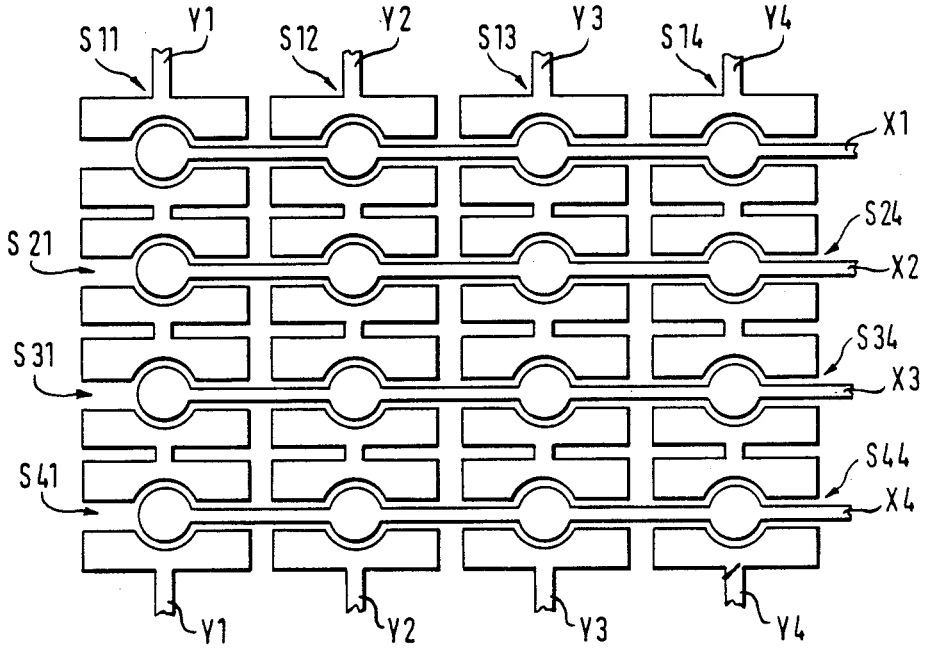
FIG. 5 is a schematic view of a matrix keyboard comprising switching contact arrangements in accordance with FIGS. 1 to 4.

FIG. 5 is a schematic view of a matrix keyboard which has been set up with the switching contact arrangement shown in FIGS. 1 to 4. A multiple of horizontal tracks X1 . . . X4 extend parallel to one another and have switching contact surfaces arranged in appropriate intervals. These are intersected by vertical tracks Y1 . . . Y4 including the enlargements according to FIG. 1. In this way a keyboard comprising switching contact arrangements S11 to S44 is formed. FIG. 5 shows only the first layer (in accordance with FIG. 1); the insulating layer and the electrically conductive layer in accordance with FIGS. 2 and 3 are not shown. FIG. 5 illustrates how a keyboard with intersecting tracks can be build in a compact manner using the switching contact arrangements in accordance with FIGS. 1 to 4. The ends of the tracks shown cut off in FIG. 5 can be made to lead out in a suitable manner as is generally known in the art.

Enlargements which are directly connected electrically to one another, e.g. the lower enlargement of the switching contact arrangement S11 and the upper enlargement of the switching contact arrangement S 21, may be connected in a single piece over their whole width. The narrower section of the track shown in FIG. 5 which connects these two enlargements may therefore extend over the complete width of the enlargements to thereby make a connection which has an even lower impedance.

All technical details explained and shown in the claims, the description and the drawing may be salient features of the invention either on their own or in any desired combination.

What is claimed is:

1. A switching contact arrangement, in particular for keyboards, comprising a support made of an electrically insulated material, further comprising two tracks disposed in one plane on the support, said tracks being each connected to a first and a second switching contact surface respectively and the switching contact surfaces which form one pair of switching contacts being spaced apart, still further comprising a movable, flexible contact surface made of an electrically conductive material, said contact surface being in contact with all switching contact surfaces associated therewith when in one of its end positions, whereas it is spaced apart from at least one of the switching contact surfaces when in the other of its end positions, and still further comprising a track intersection in which the tracks intersecting each other are separated from each other by means of an intermediate insulating layer, characterized in that an electrically conductive layer serves as a bridge (30) forming said track intersection and at the same time forms the second contact surface.

2. A switching contact arrangement according to claim 1, characterized in that the second switching contact surface (32) in addition forms a spacer for the flexible switching surface (41).

3. A switching contact arrangement according to claim 1 characterized in that the tracks (10, 12; 13, 13') intersect in the region of the switching contact arrangement while being insulated from each other by means of an intermediate insulating layer (20, 23), and that the individual switching contact surfaces (11, 32) of a switching contact pair are disposed in two different planes with respect to the support.

4. A switching contact arrangement according to claim 3, characterized in that the second track (13, 13') continues in a pair of enlargements (14, 14') in the region of the switching contact arrangement, said enlargements being arranged with a space (16, 16', 17, 17') between them and the first track (10, 12) and the switching contact surface (11) of the latter, and that these enlargements (14, 14') are connected to each other by means of a layer (30) made of an electrically conductive material, and at least one section of this layer forms the second switching contact surface (32) for the second track (13, 13') connected electrically therewith.

5. A switching contact arrangement according to claim 4, characterized in that the edges of the enlargements (14, 14') pointing towards each other enclose between them a section of the first track (10, 12) and the switching contact surface (11) thereof.

6. A switching contact arrangement according to claim 4 characterized in that the intermediate insulating layer extends additionally around about the first switching contact surface (11) to thereby partially cover it.

7. A switching contact arrangement according to claim 1, characterized in that the first switching contact surface (11) is substantially circular, that the electrically conductive layer (30) comprises a substantially circular recess (31), and the centres of the circles are aligned (axis 45).

8. A switching contact arrangement according to claim 7, characterized in that the internal diameter of the recess (31) of the conductive layer (30) is larger than the external diameter of the first switching contact surface (11).

9. A switching contact arrangement according to claim 7, characterized in that the internal diameter of the recess (31) of the conductive layer (30) is smaller or equal to the external diameter of the first switching contact surface (11), and adjacent surfaces of the first switching contact surface (11) and the conductive layer (30) are separated from each other by means of an additional part of the insulating layer (21).

10. A switching contact arrangement according to claim 6, characterized in that the part of the intermediate insulating layer (21), which extends along or about the first switching contact surface (11), is annular, and its central opening (22) is substantially circular and the centre of the latter is aligned with the circle centres of the first switching contact surface (11) and the recess (31) of the conductive layer (30) (axis 45).

11. A switching contact arrangement according to claim 1, characterized in that the intermediate insulating layer (20, 21, 23) is printed with insulating lacquer or is made of a photoresist layer.

12. A switching contact arrangement according to either of claims 1, characterized in that the electrically conductive layer (30) is printed with a conductive lacquer containing carbon or copper and carbon or carbon and silver.

13. A switching contact arrangement according to claim 7, characterised in that the internal diameter of the recess (31) of the conductive layer (30) is smaller or equal to the external diameter of the first switching contact surface (11), and opposite surfaces of the first switching contact surface (11) and the conductive layer (30) are separated from each other by means of an additional part of the insulating layer (21).

14. A keyboard, in particular a matrix keyboard, comprising a support made of an electrically insulated material, further comprising two tracks disposed in one plane on the support, said tracks being each connected to a first and a second switching contact surface respectively and the switching contact surfaces which form one pair of switching contacts being spaced apart, still further comprising a movable, flexible contact surface made of an electrically conductive material, said contact surface being in contact with all switching contact surfaces associated therewith when in one of its end positions, whereas it is spaced apart from at least one of the switching contact surfaces when in the other of its end positions, and still further comprising a track intersection in which the tracks intersecting each other are separated from each other by means of an intermediate insulating layer, characterized in that an electrically conductive layer serves as a bridge (30) forming said track intersection and at the same time forms the second contact surface.

15. A keyboard according to claim 14, characterized in that the tracks are arranged in crossing lines (X1 . . . X4) and columns (Y1 . . . Y4), and a switching contact arrangement (S11 . . . S44) is arranged in the region of each track crossing.

16. A keyboard according to claim 14, characterized in that the electrically connected enlargements of adjacent switching contact arrangements are integrally formed as a single piece, so that the track section connecting these enlargements has the same width as the enlargements themselves.

17. A keyboard according to claim 14, characterized in that the tracks (10, 12; 13, 13') intersect in the region of the switching contact arrangement while being insulated form each other by means of an intermediate insulating layer (20, 23) and that the individual switching contact surfaces (11, 32) of a switching contact pair are disposed in two different planes with respect to the support.

18. A keyboard according to claim 17, characterized in that the second track (13, 13') continues in a pair of enlargements (14, 14') in the region of the switching contact arrangement, said enlargements being arranged with a space (16, 16', 17, 17') between them and the first track (10, 12) and the switching contact surface (11) of the latter, and that these enlargements (14, 14') are connected to each other by means of a layer (30) made of an electrically conductive material, and at least one section of the layer forms the second switching contact surface (32) for the second track (13, 13') connected electrically therewith.

19. A keyboard according to claim 18 characterized in that there are a plurality of switching contact arrangements including enlargements of the tracks, which enlargements are expansive with respect to the tracks themselves.

* * * * *